US007789500B2

(12) United States Patent
Trafton et al.

(10) Patent No.: US 7,789,500 B2
(45) Date of Patent: Sep. 7, 2010

(54) PRINTING DEVICE FLUID RESERVOIR CHASSIS WITH ALIGNMENT FEATURES

(75) Inventors: R. Winfield Trafton, Brockport, NY (US); Steven L. Moore, Dansville, NY (US); Dwight J. Petruchik, Honeoye Falls, NY (US); Diana C. Petranek, Hilton, NY (US); Mark D. Perkins, Wayland, NY (US)

(73) Assignee: Eastman Kodak Company, Rochester, NY (US)

( * ) Notice: Subject to any disclaimer, the term of this patent is extended or adjusted under 35 U.S.C. 154(b) by 790 days.

(21) Appl. No.: 11/614,115

(22) Filed: Dec. 21, 2006

(65) Prior Publication Data

US 2008/0151010 A1 Jun. 26, 2008

(51) Int. Cl.
*B41J 2/175* (2006.01)
*B41J 23/00* (2006.01)

(52) U.S. Cl. ..... 347/86; 347/37

(58) Field of Classification Search ..... 347/37, 347/84, 86

See application file for complete search history.

(56) References Cited

U.S. PATENT DOCUMENTS 5,815,183 A 9/1998 Sasaki
6,155,678 A 12/2000 Komplin et al. ..... 347/86
6,779,874 B2 * 8/2004 Sturgeon et al. ..... 347/49
2002/0033857 A1 3/2002 Ohashi et al.
2003/0169318 A1 9/2003 Kline et al.

FOREIGN PATENT DOCUMENTS

EP 0 829 363 3/1998
EP 1 122 077 8/2001

OTHER PUBLICATIONS

Canon i850 printhead and tank installation, 2 pages, documentation and photos.
HP 14 Cartridge installation instruction and photos, 3 pages.
HP officejet d series, work with printheads and ink cartridges, pp. 59-70.

* cited by examiner

*Primary Examiner*—Stephen D Meier
*Assistant Examiner*—Geoffrey Mruk
(74) *Attorney, Agent, or Firm*—Justin D. Petruzzelli; David A. Novais; Eugene I. Shkurko

(57) ABSTRACT

Various embodiments of a printing device fluid reservoir with alignment features and various embodiments of a printing device fluid reservoir chassis with alignment features are disclosed. According to some aspects of these embodiments, the alignment features are grouped together near an ultimate connection point between a fluid reservoir and a chassis to increase design freedom on other regions of the fluid reservoir/chassis. Other aspects of these embodiments include specially designed and located alignment features of a fluid reservoir that engage specially designed and located alignment features of a chassis in sequence throughout the process of inserting the fluid reservoir into the chassis in order to facilitate simple and effective engagement.

14 Claims, 14 Drawing Sheets

PRINTING DEVICE FLUID RESERVOIR CHASSIS WITH ALIGNMENT FEATURES

CROSS REFERENCE TO RELATED APPLICATIONS

This application is related to U.S. patent application Ser. No. 11/614,125 titled "PRINTING DEVICE FLUID RESERVOIR WITH ALIGNMENT FEATURES," by R. Winfield Trafton, et al., and filed Dec. 21, 2006 concurrently herewith, the entire disclosure of which is hereby incorporated herein by reference.

FIELD OF THE INVENTION

This invention relates to fluid-ejection printing devices. In particular, this invention pertains to fluid reservoirs and fluid-reservoir-chassis of such printing devices. In particular, this invention relates to the proper insertion of a fluid reservoir into a chassis of such a printing device.

BACKGROUND OF THE INVENTION

Fluid-ejection printing devices, such as ink jet printers, commonly have at least one fluid reservoir and a chassis that supports the fluid reservoir. The fluid reservoir may contain one or more fluid chambers that provide fluid to a printhead. If the fluid reservoir has more than one ink chamber, each such chamber often retains fluid of a different color for multicolor printing. On the other hand, if the fluid reservoir has only a single ink chamber, typically such chamber is used to retain black ink for black-and-white printing.

Commonly, the printhead die is connected directly or indirectly to the chassis. In order to form an image, the printhead die, along with the chassis and the fluid reservoir, typically are moved in a lateral direction (substantially parallel to the plane of the printhead die) across a width of a substrate, such as paper, as fluid is ejected from the printhead. After the printhead forms a row-portion of the image along the width of the substrate, the substrate is advanced in a direction perpendicular to the lateral direction along a length of the substrate, so that the printhead can form a subsequent row-portion of the image. This process of advancing the substrate for each row-portion is repeated until a next substrate is needed or the image is completed.

When an ink chamber in the fluid reservoir runs out of fluid, a user is charged with the responsibility of removing the empty fluid reservoir from the chassis and replacing it with a full fluid reservoir. Consequently, the task of replacing a fluid reservoir into the chassis must be simple and must consistently achieve a proper engagement of the fluid reservoir into the chassis. Otherwise, improper insertion of the fluid reservoir into the chassis may lead to damage to the printing device due to fluid leaks, may cause poorly formed images due to an improper communication of fluid from the fluid reservoir to the printhead, and may result in user frustration. Furthermore, if it is not easy for a user to insert a fluid reservoir into a chassis, or if proper installation is not apparent to the user, the user may resort to using excessive force when inserting the fluid reservoir into the chassis. In this case, excessive contact between fragile components on the fluid reservoir and/or the chassis may occur, thereby resulting in damage. Accordingly, a need in the art exists for an insertion-solution that allows a user to simply and reliably insert a fluid reservoir into a chassis of a fluid-ejecting printing device.

SUMMARY OF THE INVENTION

The above-described problems are addressed and a technical solution is achieved in the art by a printing device fluid reservoir with alignment features and a printing device fluid reservoir chassis with alignment features according to embodiments of the present invention.

According to an embodiment of the present invention, a fluid reservoir having alignment features that facilitate proper insertion of the fluid reservoir into a chassis is provided. According to an embodiment of the present invention, the alignment features are grouped in a region near an ultimate connection point between the fluid reservoir and the chassis in order to increase design flexibility for other areas of the fluid reservoir. In an embodiment of the present invention, the ultimate connection point is between a fluid discharge port of the fluid reservoir and a fluid reception port of the chassis.

According to an embodiment of the present invention, the alignment features include protrusions from the fluid reservoir device that interact with guide features of the chassis, such interaction guiding the fluid reservoir into an engaged position into the chassis. According to an embodiment of the present invention, a first of these protrusions extends from a first surface of the fluid reservoir, and a second of these protrusions extends from a second surface of the fluid reservoir. The first protrusion and the second protrusion may occupy a same relative position on the first surface and the second surface, respectively. The first surface and the second surface may face opposite or substantially opposite directions and/or may be parallel or substantially parallel to each other.

The first protrusion, according to an embodiment of the invention, is a rib-like structure. According to another embodiment of the present invention, the first protrusion is a tab-like structure. According to yet another embodiment of the present invention, the first protrusion spans a distance greater than or equal to a distance in which the first protrusion extends from the first surface of the fluid reservoir. The second protrusion may be identical or substantially identical to the first protrusion.

According to an embodiment of the present invention, a first axis that extends between portions of the first and second protrusions that interact with the guide features of the chassis is parallel or substantially parallel to a plane in which the chassis is configured to operate in the printing device. A portion of the first protrusion that interacts with a first guide feature of the chassis, according to an embodiment of the present invention, is rounded to facilitate ease of guiding the fluid reservoir into the chassis. The second protrusion may, like the first protrusion, have a portion that is rounded that interacts with a second guide feature of the chassis. According to an embodiment of the present invention, the portions of the first and second protrusions are bottom sides, respectively, of the first and second protrusions.

According to another embodiment of the present invention, the fluid reservoir may have a third protrusion that extends from a third surface of the fluid reservoir. According to an embodiment of the present invention, the third surface is substantially perpendicular or perpendicular to the first and/or second surfaces of the fluid reservoir. According to an embodiment of the present invention, the third protrusion is configured to extend into an opening in the chassis when the fluid reservoir is being inserted into the chassis. According to an embodiment of the present invention, the third protrusion is configured to interact with the opening in the chassis so as to prevent the fluid discharge port from excessively contacting or contacting the fluid reception port of the chassis during a process of inserting the fluid reservoir into the chassis. In this regard, according to an embodiment of the present invention, a distance between the third protrusion and a bottom surface of the fluid discharge port is enough to protect the fluid discharge port from excessively contacting the fluid reception port upon insertion. Also in this regard, according to an embodiment of the present invention, the fluid discharge port may have an oval or rectangular shape to further assist in preventing the fluid discharge port from excessively contacting the fluid reception port during insertion.

According to yet another embodiment of the present invention, the alignment features of the fluid reservoir include one or more additional alignment features closer to the fluid discharge port than the third protrusion. These additional alignment features may extend substantially a width of the fluid reservoir. According to an embodiment of the present invention, these additional alignment features are near a bottom surface of the fluid reservoir where the fluid discharge port exists, but are not on this bottom surface. According to an embodiment of the present invention, these additional alignment features engage at or just before complete installation of the fluid reservoir into the chassis. According to yet another embodiment of the present invention, a width of the additional alignment features in a width direction perpendicular to a plane in which the fluid reservoir is configured to operate, is greater than a width of the third protrusion in the width direction. Such an arrangement prevents the additional alignment features from getting caught in the opening in the chassis with which the third protrusion is configured to interact during installation of the fluid reservoir into the chassis.

According to an embodiment of the present invention, the alignment features of the fluid reservoir engage with alignment features of the chassis in sequence throughout the process of inserting the fluid reservoir into the chassis. According to an embodiment of the present invention, the first and second protrusions of the fluid reservoir that are configured to interact with the first and second guide features, respectively, of the chassis are first to engage and interact to guide the fluid reservoir towards an engaged position in the chassis. Subsequently, the third protrusion of the fluid reservoir engages with the opening in the chassis with which it is configured to interact, according to an embodiment of the invention, to prevent the fluid discharge port from excessively contacting the fluid reception port during the process of inserting the fluid reservoir into the chassis. According to still yet another embodiment of the present invention, the additional alignment features engage subsequently to the engagement of the third protrusion and the opening. Sequencing of engagement of multiple alignment features, according to embodiments of the present invention, improves the ease and reliability upon which the fluid reservoir is inserted into the chassis.

According to yet another embodiment of the present invention, a printing device fluid reservoir chassis is provided with a surface that opposes a direction in which the fluid reservoir is inserted into the chassis. According to an embodiment of the present invention, this surface has an inflection axis that may be convex towards the inside of the chassis to facilitate proper insertion of the fluid reservoir into the chassis. Such inflection axis facilitates a transition of control from one or more alignment features in a first alignment region of the chassis to one or more alignment features in a second alignment region of the chassis. According to an embodiment of the present invention, this inflection axis may facilitate transition of control from the engagement of a third protrusion with the opening in the chassis to the additional alignment features located closer to the fluid discharge port than the third protrusion on the fluid reservoir during the insertion process.

In addition to the embodiments described above, further embodiments will become apparent by reference to the drawings and by study of the following detailed description.

BRIEF DESCRIPTION OF THE DRAWINGS

The present invention will be more readily understood from the detailed description of exemplary embodiments presented below considered in conjunction with the attached drawings, of which.

It is to be understood that the attached drawings are for purposes of illustrating the concepts of the invention and may not be to scale.

DETAILED DESCRIPTION

Embodiments of the present invention include fluid reservoirs that have alignment features configured to interact with alignment features of a supporting chassis. According to embodiments of the present invention, the alignment features on either or both the fluid reservoir and/or the chassis are grouped in a region near an ultimate connection point between the fluid reservoir and the chassis. In an embodiment, such connection point is a point where ink is transferred from the fluid reservoir to the chassis (and ultimately to a printhead). An advantage of grouping alignment features near an ultimate connection point is to increase design flexibility for other areas of the fluid reservoir and/or chassis. For example, if alignment features are grouped in a particular region on a fluid reservoir, other regions of the fluid reservoir may be designed without having to accommodate the alignment features in such other regions. Further, by grouping the alignment features near an ultimate connection point, alignment between the fluid reservoir and the chassis may be more effectively and securely achieved than if the alignment features are located remotely from such connection point.

Other aspects of embodiments of the present invention include ensuring proper insertion of a fluid reservoir into a chassis while reducing the risk of damage to sensitive components by excessive contact. For example, in one embodiment of the present invention, alignment features interact to prevent a fluid discharge port on a fluid reservoir from contacting or excessively contacting a fluid reception port on the chassis during installation of the fluid reservoir into the chassis.

Still other aspects of embodiments of the present invention include a sequencing of engagement of alignment features between a fluid reservoir and a chassis throughout the process of installing the fluid reservoir into the chassis. Such sequencing facilitates easy and proper insertion of the fluid reservoir into the chassis with reduced risk of damage to sensitive components.

These aspects and other aspects will become apparent upon the following description of the included figures.

Figure 1:
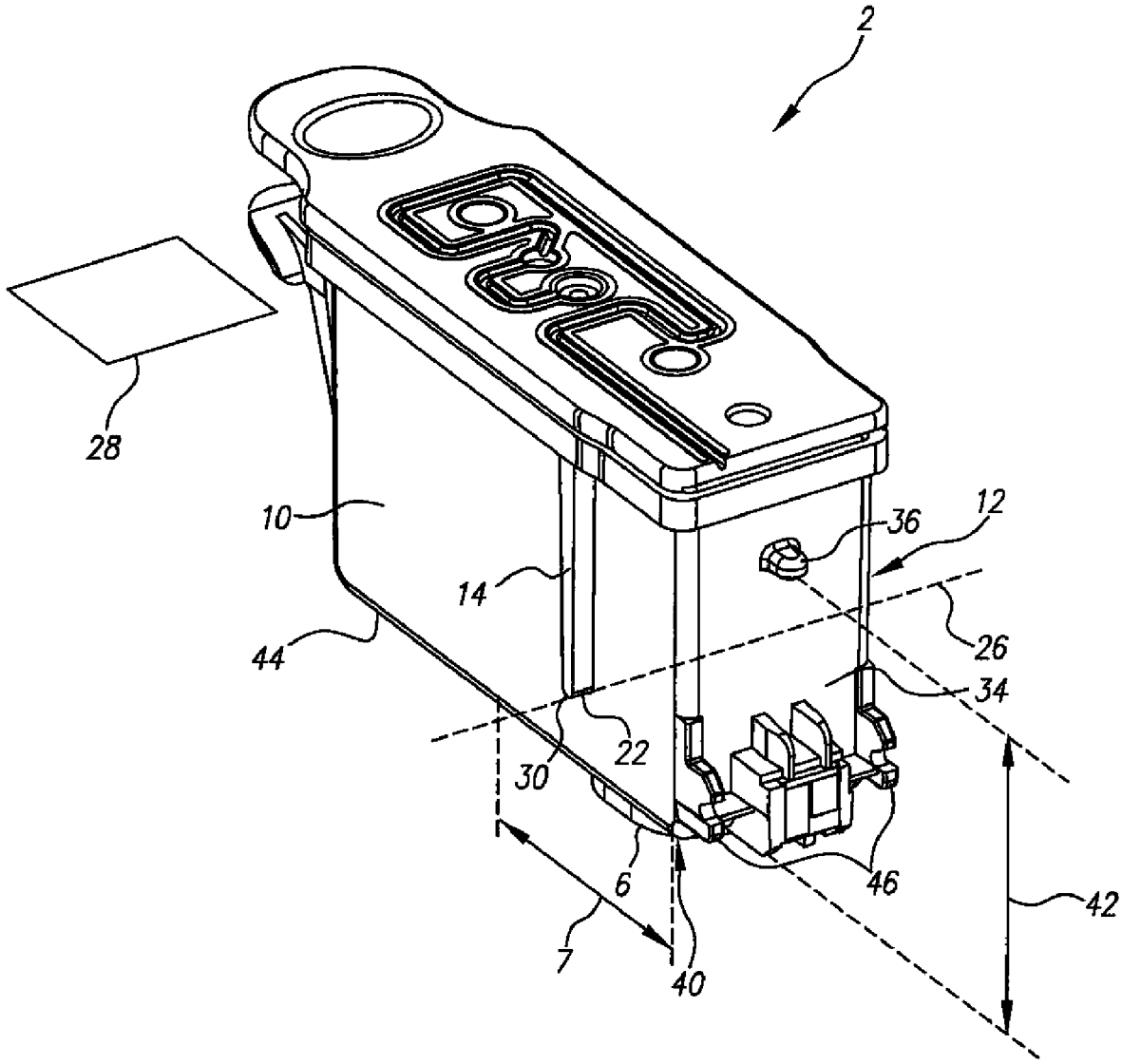
FIGS. 1 and 2 illustrate differing views of a single chamber fluid reservoir, according to an embodiment of the present invention.
Figure 2:
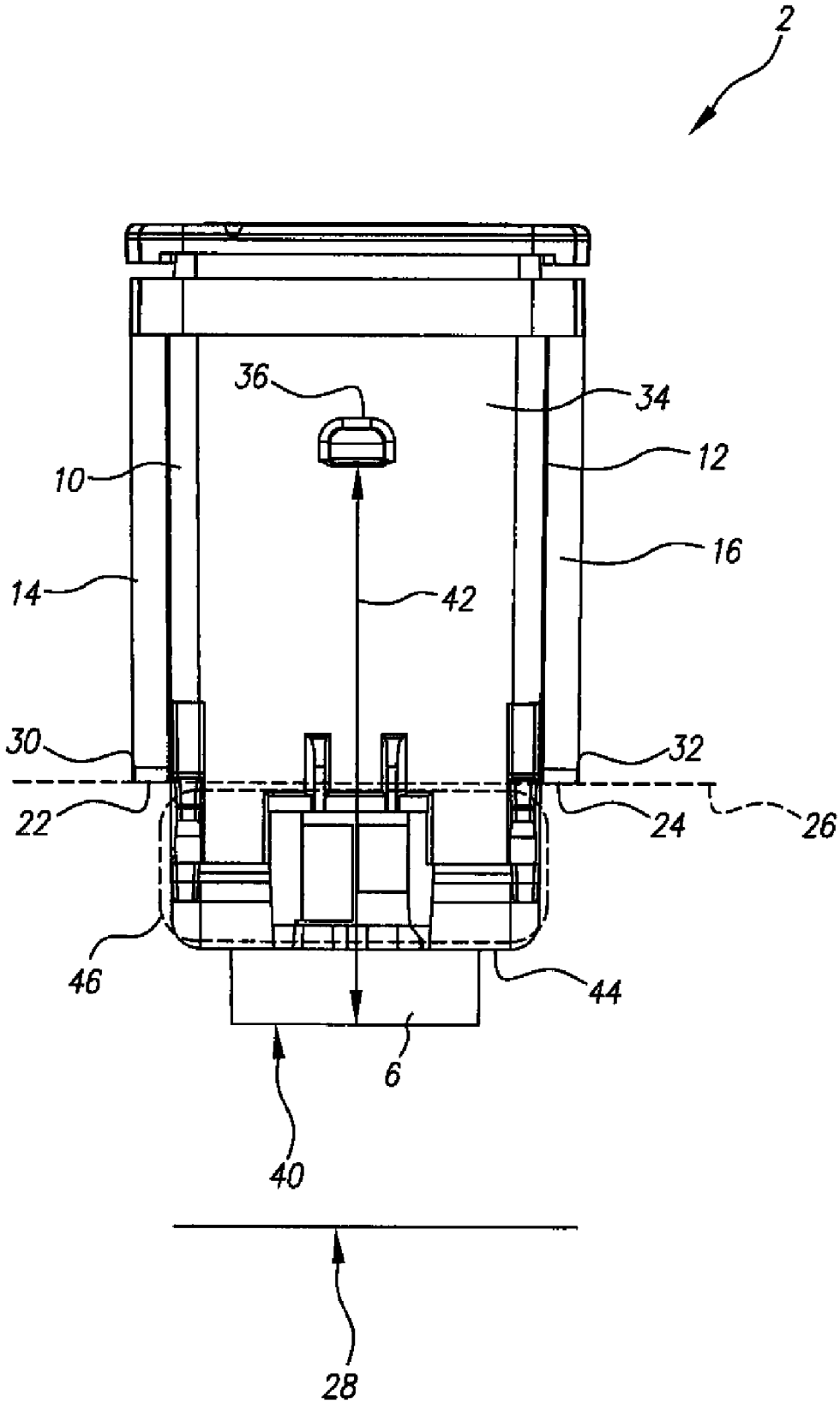

With reference to FIGS. 1 and 2, a single-chamber fluid reservoir 2 with alignment features is illustrated, according to an embodiment of the present invention. According to the embodiment of FIGS. 1 and 2, the fluid reservoir 2 includes a bottom surface 44, from which a fluid discharge port 6 extends. Fluid in a fluid chamber (not shown) within the fluid reservoir 2 is communicated through the fluid discharge port 6 to a fluid reception port 8 of a chassis 4, (illustrated in FIGS. 5 and 6 and described in more detail below).

The fluid reservoir 2 includes a plurality of alignment features, such as a first protrusion 14, a second protrusion 16, a third protrusion 36, and additional alignment features 46. Although the embodiment of FIGS. 1 and 2 illustrate all of these features 14, 16, 36, 46, on a single fluid reservoir 2, the present invention includes within its scope the use of a subset of these features, because each particular feature may provide its own benefits and need not necessarily be used in combination with the other features.

According to the embodiment of FIGS. 1 and 2, the first protrusion 14 extends from a first surface 10 of the fluid reservoir, and the second protrusion 16 extends from a second surface 12 of the fluid reservoir. Although not required, the first surface 10 and the second surface 12 may be flat or substantially flat. Further, according to the embodiment of FIGS. 1 and 2, the first surface 10 and the second surface 12 face opposite or substantially opposite directions and are parallel or substantially parallel. However, one skilled in the art will appreciate that the first surface 10 and the second surface 12 could be slanted so that they lie within intersecting planes to the extent they are flat or substantially flat. Further in this regard, one skilled in the art will appreciate that the first surface 10 and the second surface 12 could be rounded and/or could actually form different parts of a same surface.

Although not required, the first protrusion 14 in the embodiment shown in FIGS. 1 and 2 spans a distance along the first surface 10 greater than a distance that the first protrusion 14 extends from the first surface 10. Similarly, the second protrusion 16 spans a distance along the second surface 12 greater than a distance that the second protrusion 16 extends from the second surface 12. In this regard, the first protrusion 14 and the second protrusion 16 may have a rib-like structure. One skilled in the art will appreciate, however, that other shapes for the first protrusion 14 and the second protrusion 16 may be used. For example, the first protrusion 14 and the second protrusion 16 may be tab-, peg-, or post-like in that they extend a distance along the first surface 10 and the second surface 12, respectively, less than, equal to, or substantially equal to a distance that the first protrusion 14 and the second protrusion 16, respectively, extend from such surfaces. In addition, although the embodiment of FIGS. 1 and 2 illustrates that the first protrusion 14 and the second protrusion 16 have an identical shape, one skilled in the art will appreciate that this need not be the case. What is preferable is that a portion 30 of the first protrusion 14 and a portion 32 of the second protrusion 16 be located in a same or substantially a same relative position on the surfaces 10, 12, respectively, so that they are able to align the fluid reservoir 2, upon interaction with guide features in the chassis, along or substantially along a plane in which the fluid reservoir 2 is intended to operate. In this regard, a first axis 26 extending through the portions 30, 32 of the first protrusion 14 and the second protrusion 16, respectively, is parallel to or substantially parallel to a plane 28 in which the fluid reservoir 2 is intended to operate. Plane 28 is the plane in which the fluid reservoir and chassis are moved during printing. Plane 28 is also substantially parallel to the bottom surface 40 of the discharge port(s) 6 during operation. In other words, portions 30, 32 of the first protrusion 14 and the second protursion 16 are located at the same relative distance above the bottom surface 40 of discharge port(s) 6. As will be discussed in more detail below, it is intended that portions 30 and 32 of the first and second protrusions, respectively, contact the tops of guide features in the chassis. Therefore, portions 30 and 32 are located at or near the bottom of protrusions 14 and 16 respectively, e.g. they may be the portions of protrusions 14 and 16 respectively that are closest to the bottom surface 44. In this regard, the portions 30, 32 may be bottom sides 22, 24, respectively, of the protrusions 14, 16.

The third protrusion 36, according to the embodiment of FIGS. 1 and 2, extends from a third surface 34 of the fluid reservoir 2. According to this embodiment, the third surface 34 is perpendicular or substantially perpendicular to the first surface 10 and the second surface 12. Further according to this embodiment, the third surface 34 is flat or substantially flat. However, one skilled in the art will appreciate that the third surface need not be flat and could be curved. In this regard, the third surface 34 need not be a surface separate from the first surface 10 or the second surface 12. Consequently, the first surface 10, the second surface 12, and the third surface 34, or combinations thereof, may more aptly be considered different regions of a same surface.

According to the embodiment of FIGS. 1 and 2, the third protrusion 36 extends in a direction perpendicular to or substantially perpendicular to a direction in which the fluid discharge port 6 faces. As will be illustrated in more detail throughout the remainder of this description, a distance 42 between the third protrusion 36 and a bottom surface 40 of the fluid discharge port 6 is such that the third protrusion 36 prevents the fluid discharge port 6 from excessively contacting its corresponding fluid reception port 8 of the chassis 4 during the insertion of the fluid reservoir 2 into the chassis 4.

Figure 3:
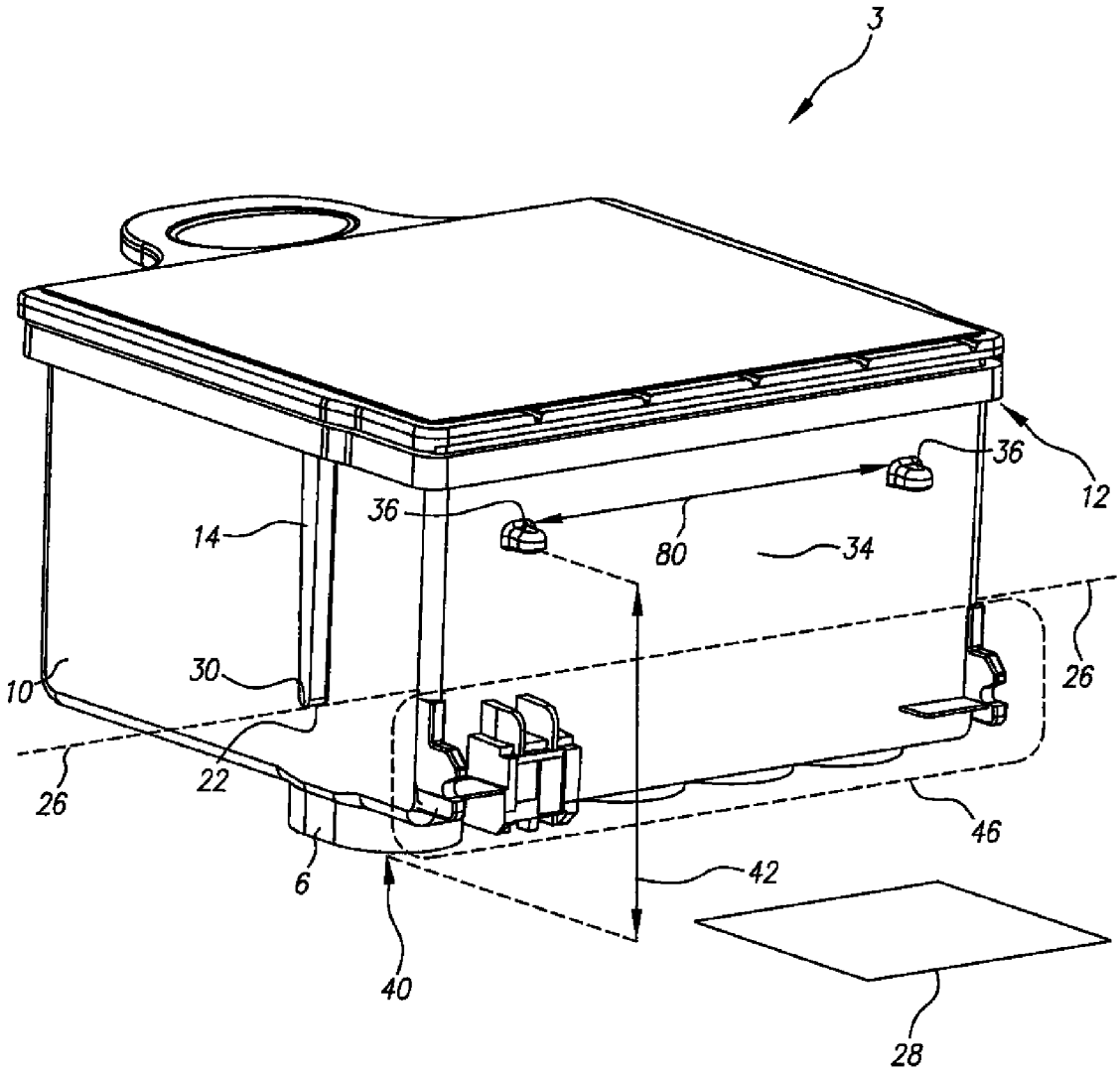
FIGS. 3 and 4 illustrate differing views of a multi-chamber fluid reservoir, according to an embodiment of the present invention.
Figure 4:
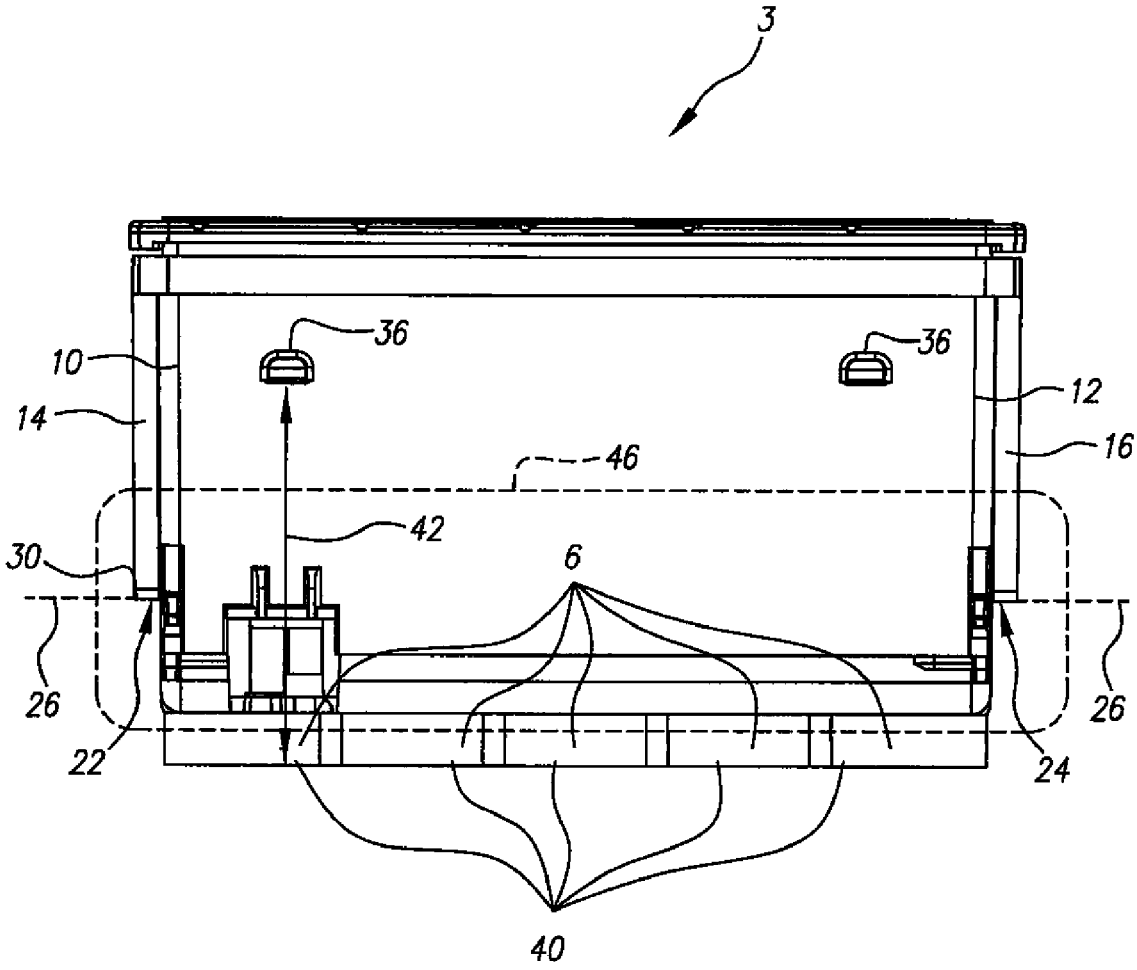

FIGS. 3 and 4 illustrate differing views of a multi-chamber fluid reservoir 3, according to an embodiment of the present invention. Like reference numerals have been used to illustrate same or similar-features. The fluid reservoir 3 differs from the fluid reservoir 2 in that it contains multiple fluid chambers (not shown). In the embodiment of FIGS. 3 and 4, the multi-chamber reservoir 3 has four different fluid chambers, each of which may be used to retain its own supply of fluid. Commonly, each chamber is used to retain fluid of a different color, such as cyan, magenta, yellow, and black.

The multi-chamber fluid reservoir 3, according to the embodiment of FIGS. 3 and 4, also differs from the single-chamber fluid reservoir 2 in that it includes two third protrusions 36. According to this embodiment, the third protrusions 36 are spread out along a width direction of the fluid reservoir 3 parallel to or substantially parallel to the plane 28. The width 80 between the third protrusions 36 may be wide enough to improve stability of the fluid reservoir 3, i.e., to improve its balance during a process of inserting the fluid reservoir 3 into and while inserted into a chassis 4. Sufficient width 80 between protrusions 36 also helps to prevent excessive contact between each of the ports 6 and its corresponding fluid reception port 8 during the insertion of fluid reservoir 3 into chassis 4. Similarly, according to the embodiment of FIGS. 3 and 4, the additional alignment features 46 also are spread out along a width direction of the fluid reservoir 3. Such an arrangement may be used to improve stability of the fluid reservoir 3.

Although the embodiment of FIGS. 3 and 4 illustrate two spread-out third protrusions 36, one skilled in the art will appreciate that the a process of inserting a fluid reservoir into a chassis may still be improved over conventional designs with only a single third protrusion 36 on a multi-chamber fluid reservoir or multiple third protrusions 36 not spread out along a width of a multi-chamber fluid reservoir. On the other hand, more than two third protrusions 36 also may be used. Accordingly, one skilled in the art will appreciate that the invention is not limited to the number or particular arrangement of third protrusions 36 on a multi-(or a single-) chamber fluid reservoir. Further in this regard, one skilled in the art will appreciate that improved insertion over conventional techniques may be achieved using other alignment features described herein without the third protrusion(s) 36. Accordingly, one skilled in the art also will appreciate that the third protrusion(s) 36 may be used to improve insertion over other embodiments of the present invention, but such third protrusion(s) is/are not necessary to obtain improvement over conventional techniques.

As can be seen with the embodiment of FIGS. 1 and 2 and the embodiment of FIGS. 3 and 4, alignment features may be grouped near the fluid discharge ports 6 in order to provide efficient and effective insertion of a fluid reservoir into a chassis without occupying a substantial amount of surface area on the fluid reservoir with alignment features. Such an arrangement may be preferable if flexibility of design of the fluid reservoir is needed. In other words, if alignment features are grouped near an ultimate connection point between the fluid reservoir and the chassis, such as a connection between a fluid discharge port 6 and a fluid reception port 8, other regions of the fluid discharge port may be designed without being constrained by placement of such alignment features. In the embodiments of FIGS. 1-4, the following alignment features are located near the fluid discharge port(s) 6: the portions 30, 32 of the first and second protrusions 14, 16, respectively; the third protrusion(s) 36; and the additional alignment features 46. Although all of these alignment features are illustrated as near the fluid discharge port(s) 6, one skilled in the art will appreciate that all alignment features need not be located near the ultimate connection point. However, every alignment feature located near the ultimate connection point allows other regions of the fluid reservoir to be more freely designed. Accordingly, it may be suitable if most of the alignment features are located near the ultimate connection point. Or, it may be more suitable if all or all-but-one of the alignment features are located near the ultimate connection point.

One example of "near" the ultimate connection point, according to an embodiment of the invention, is that if all or substantially all of the ultimate connection point is located on a first half of the fluid reservoir, then at least most of the plurality of alignment features are located on the first half of the fluid reservoir. Another example of "near" the ultimate connection point according to an embodiment of the invention, is that a volume generated by connecting the ultimate connection point and the alignment features near the ultimate connection point occupies less than approximately 40% of the volume occupied by the fluid reservoir. According to another embodiment of the present invention, such volume occupies less than approximately 25% of the volume occupied by the fluid reservoir. According to still yet another embodiment of the present invention, such volume occupies less than approximately 15% of the volume occupied by the fluid reservoir.

Figure 5:
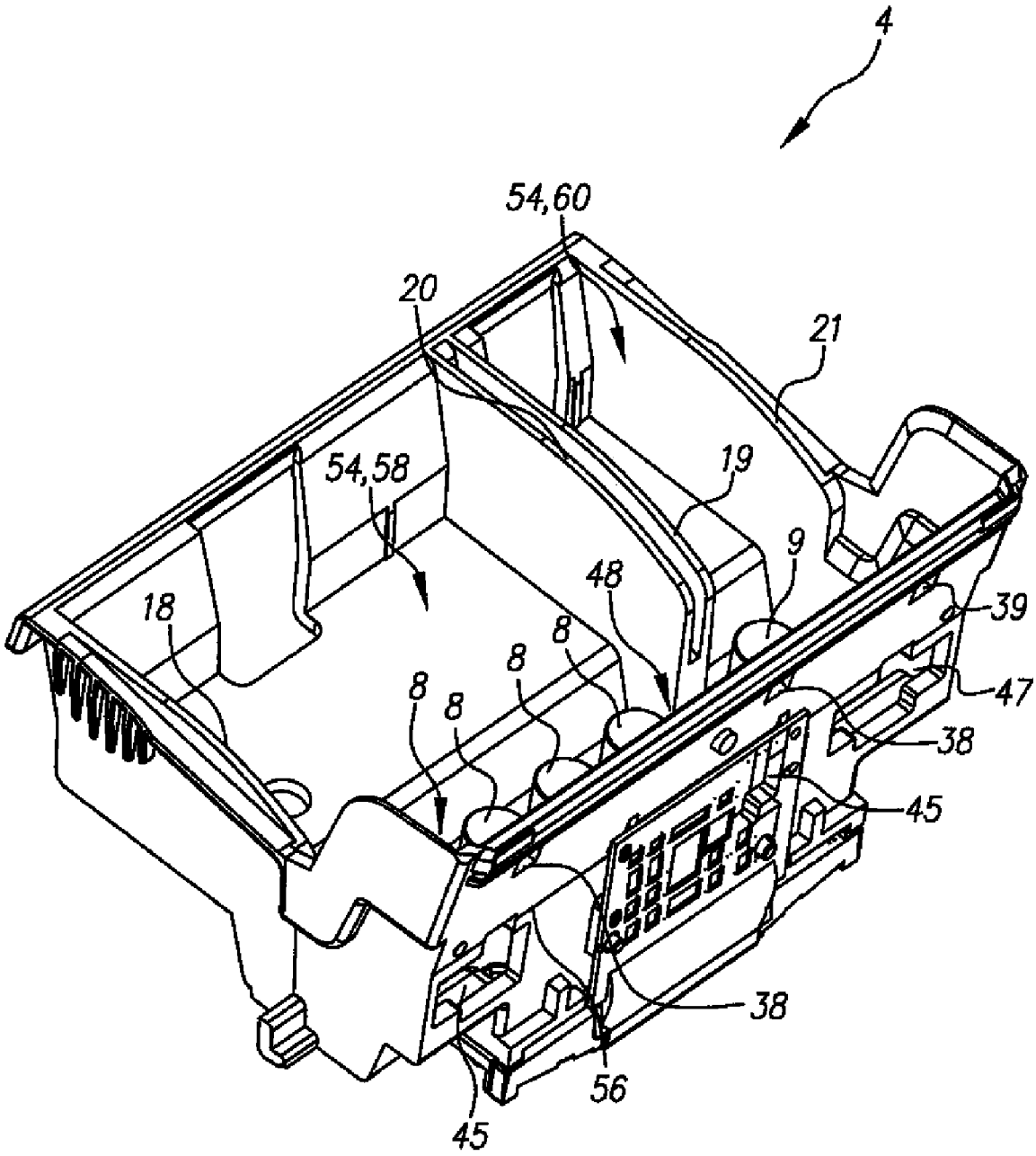
FIGS. 5-7 illustrate different views of a multi-reservoir chassis, according to an embodiment of the present invention.
Figure 6:
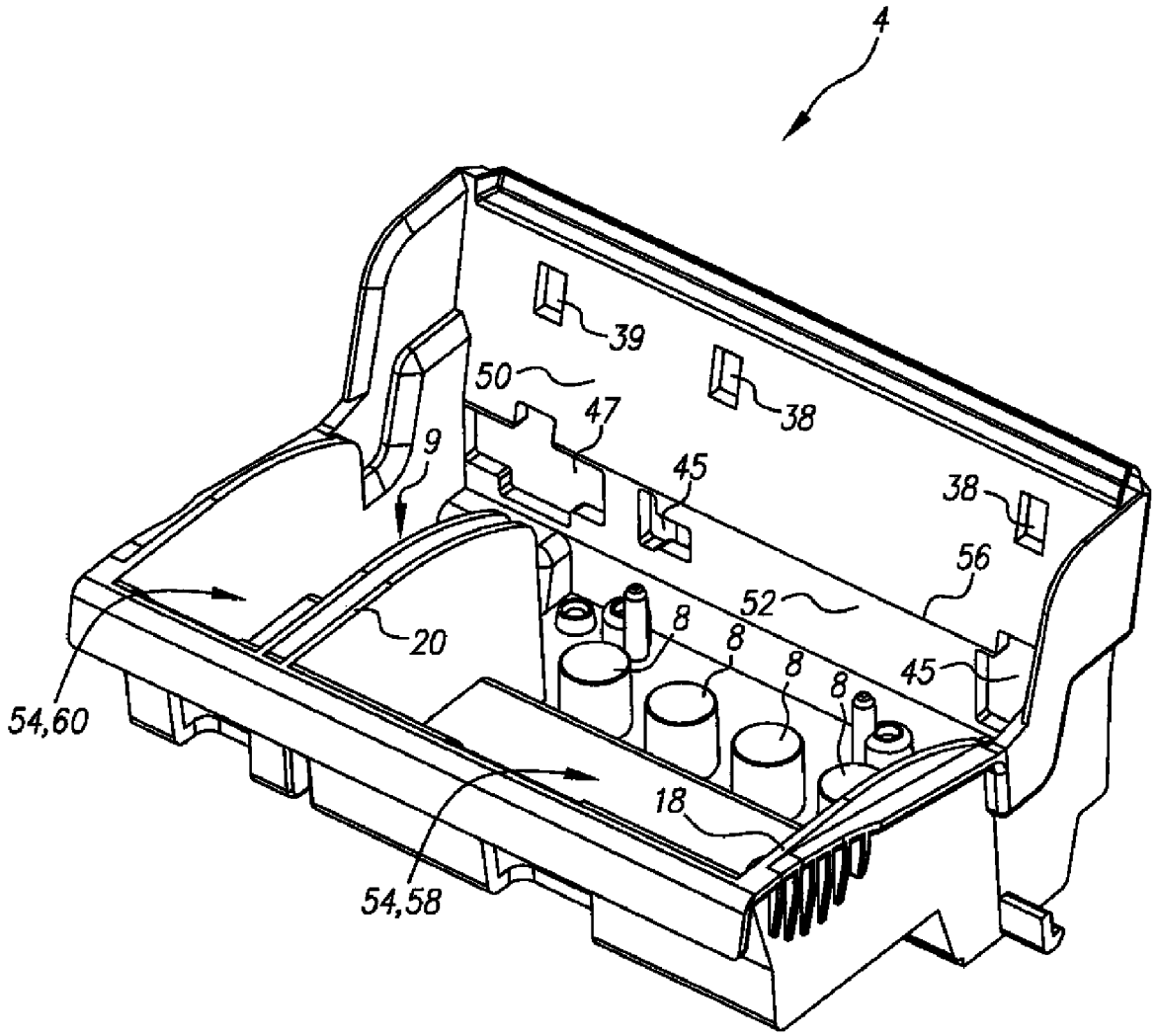
Figure 7:
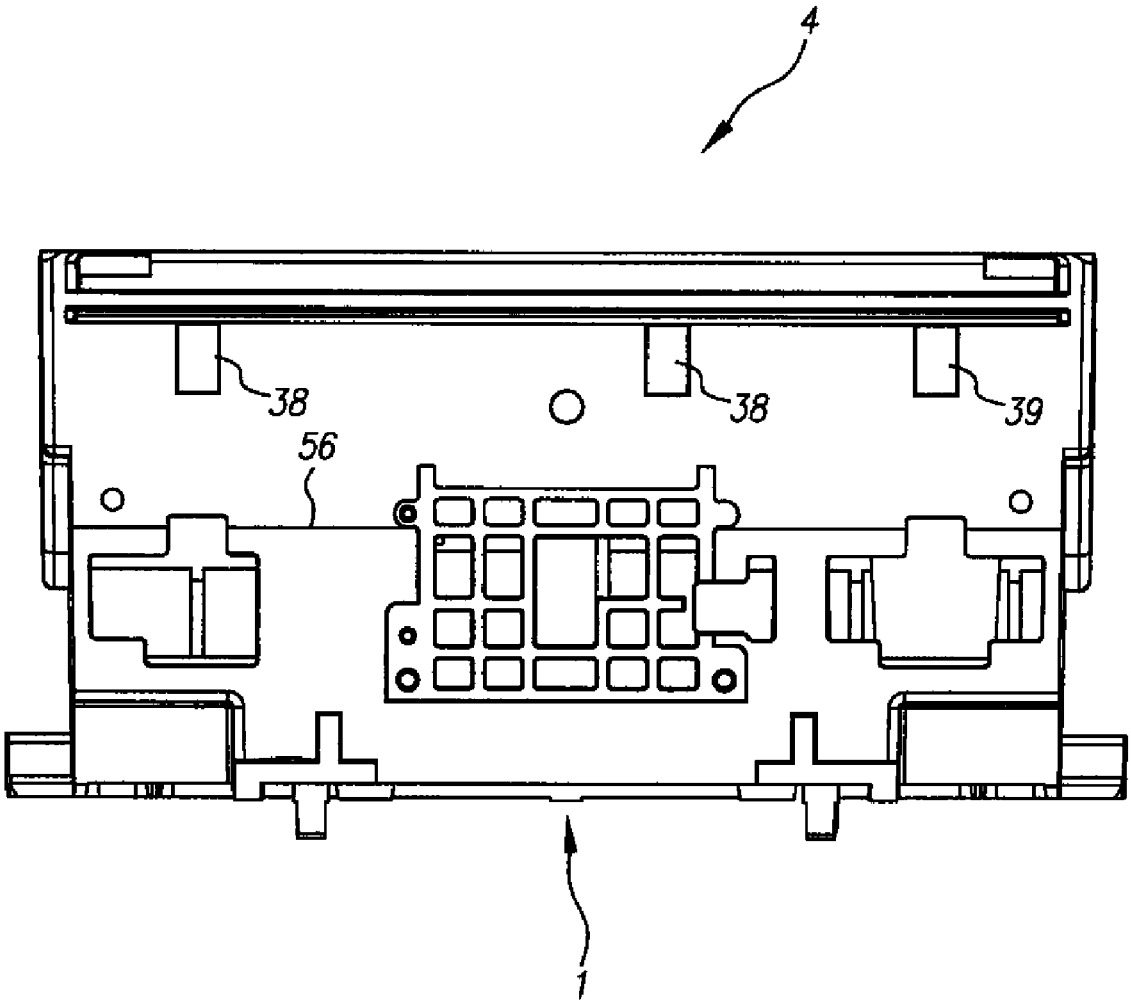

Turning now to FIGS. 5, 6, and 7, a multi-reservoir chassis 4, according to an embodiment of the present invention, is illustrated. The chassis 4, according to this embodiment, has an inside 54 separated into two regions 58, 60. The region 58 is configured with fluid reception ports 8 to receive a multi-chamber fluid reservoir, such as the fluid reservoir 3 shown in FIGS. 3 and 4. The region 60, according to this embodiment, is configured with fluid reception port 9 to receive a single chamber fluid reservoir, such as the fluid reservoir 2 illustrated in FIGS. 1 and 2. Fluid from reservoirs 2, 3 travels from discharge ports 6 to reception ports 8 and 9; from there it travels to a fluid manifold (not shown); and from there it travels to printhead die 1, which is attached to an outside surface of the chassis 4. Although the embodiment of FIGS. 5-7 illustrate a multi-reservoir chassis 4 configured to receive both a multi-chamber fluid reservoir and a single-chamber fluid reservoir, one skilled in the art will appreciate that a single-reservoir chassis could be devised according to aspects of the invention illustrated herein.

According to the embodiment of FIGS. 5-7, the region 60 has a first guide feature 19 and a second guide feature 21 configured to interact with the first protrusion 14 and the second protrusion 16 of the single-chamber fluid reservoir 2. The region 60 also has a single fluid reception port 9 configured to interact with the fluid discharge port 6 of the fluid reservoir 2. Further, the chassis 4, according to this embodiment, has an opening 39 configured to interact with the third protrusion 36 of the fluid reservoir 2. In addition, the chassis 4 has an opening 47 in region 60 configured to interact with the additional alignment features 46 of the fluid reservoir 2.

Similarly, the region 58 has a first guide feature 18 and a second guide feature 20, according to the embodiment of FIGS. 5-7, configured to interact with the first protrusion 14 and the second protrusion 16 of the multi-chamber fluid reservoir 3. The region 58 also has multiple fluid reception ports 8 configured to interact with the fluid discharge ports 6 of the multi-chambered fluid reservoir 3.

If a multi-chamber fluid reservoir having multiple third protrusions 36 is used, as shown in FIGS. 3 and 4, the embodiment of FIGS. 5-7 includes multiple openings 38 configured to interact with each of the third protrusions 36. Similarly, it also may be advantageous to have multiple openings 45 configured to interact with additional alignment features 46 spread out along a width of a fluid reservoir, such as fluid reservoir 3 shown in FIGS. 3 and 4. In this instance, the openings 45 are configured to interact portions of the additional alignment features 46 shown in FIGS. 3 and 4 that protrude from the multi-chamber fluid reservoir 3.

Another feature of the chassis 4, according to the embodiments disclosed in FIGS. 5-7, is that a surface 48 bends along an inflection axis 56. According to this embodiment, the surface 48 opposes a direction in which the fluid reservoir 2 is inserted into the chassis 4, and the inflection axis 56 separates a first alignment region 50 from a second alignment region 52 of the surface 48. The first alignment region 50 is in or on the surface 48 of the chassis 4 and is configured to interact with an alignment feature of the fluid reservoir, such as the third protrusion(s) 36. The second alignment region 52 is in or on the surface 48 of the chassis 4 and is configured to interact with a second alignment feature of the fluid reservoir, such as the additional alignment features 46. The inflection axis 56, as will be described in more detail below, facilitates transfer of control from one alignment feature to another alignment feature during the process of installing the fluid reservoir(s) 2 and/or 3 into the chassis 4. In one embodiment of the present invention, the inflection axis 56 transfers alignment control from the third protrusion(s) 36 of the fluid reservoir(s) 2 and/or 3 to the additional alignment features 46 of the fluid reservoir(s) 2 and/or 3.

Figure 8:
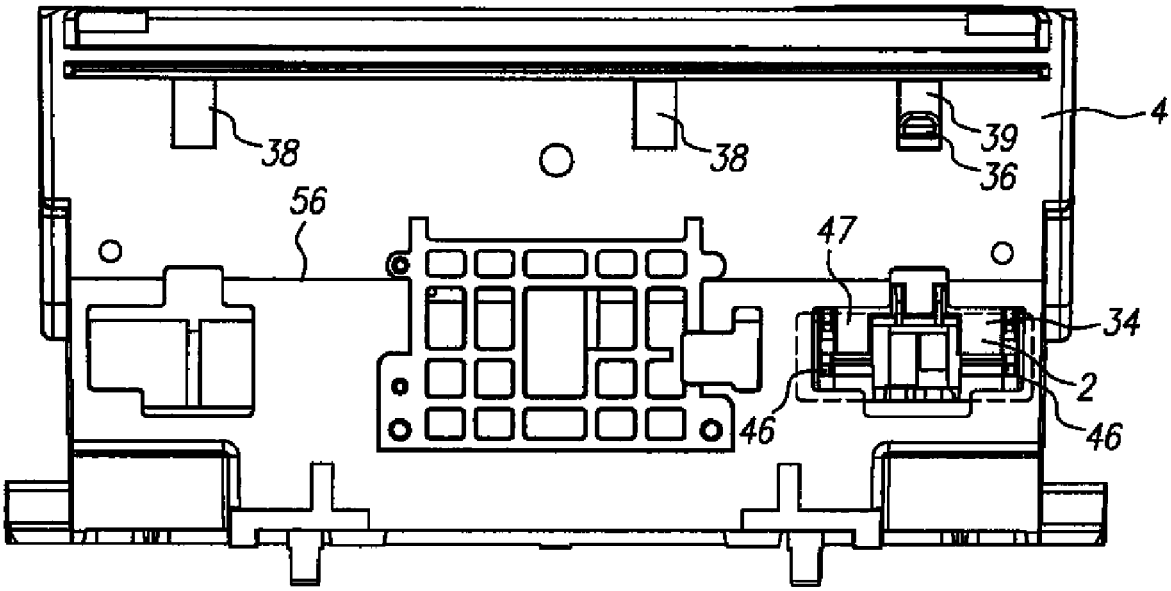
FIG. 8 illustrates the multi-reservoir chassis of FIGS. 5-7 having a single-chamber fluid reservoir inserted therein, according to an embodiment of the present invention.
Figure 9:
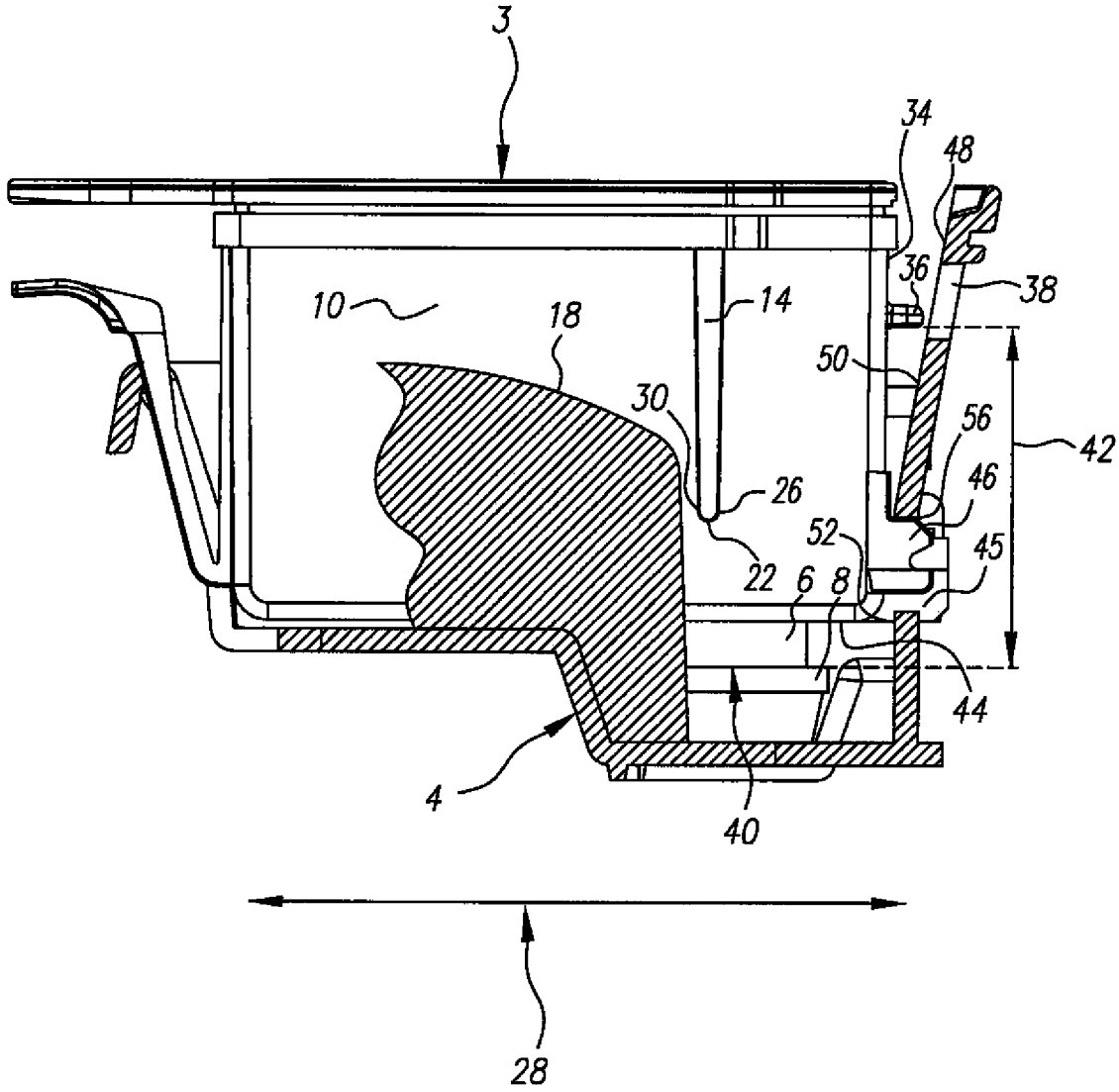
FIG. 9 illustrates a side view of the multi-reservoir chassis of FIGS. 5-7 having a multi-chamber fluid reservoir inserted therein, according to an embodiment of the present invention.
Figure 10:
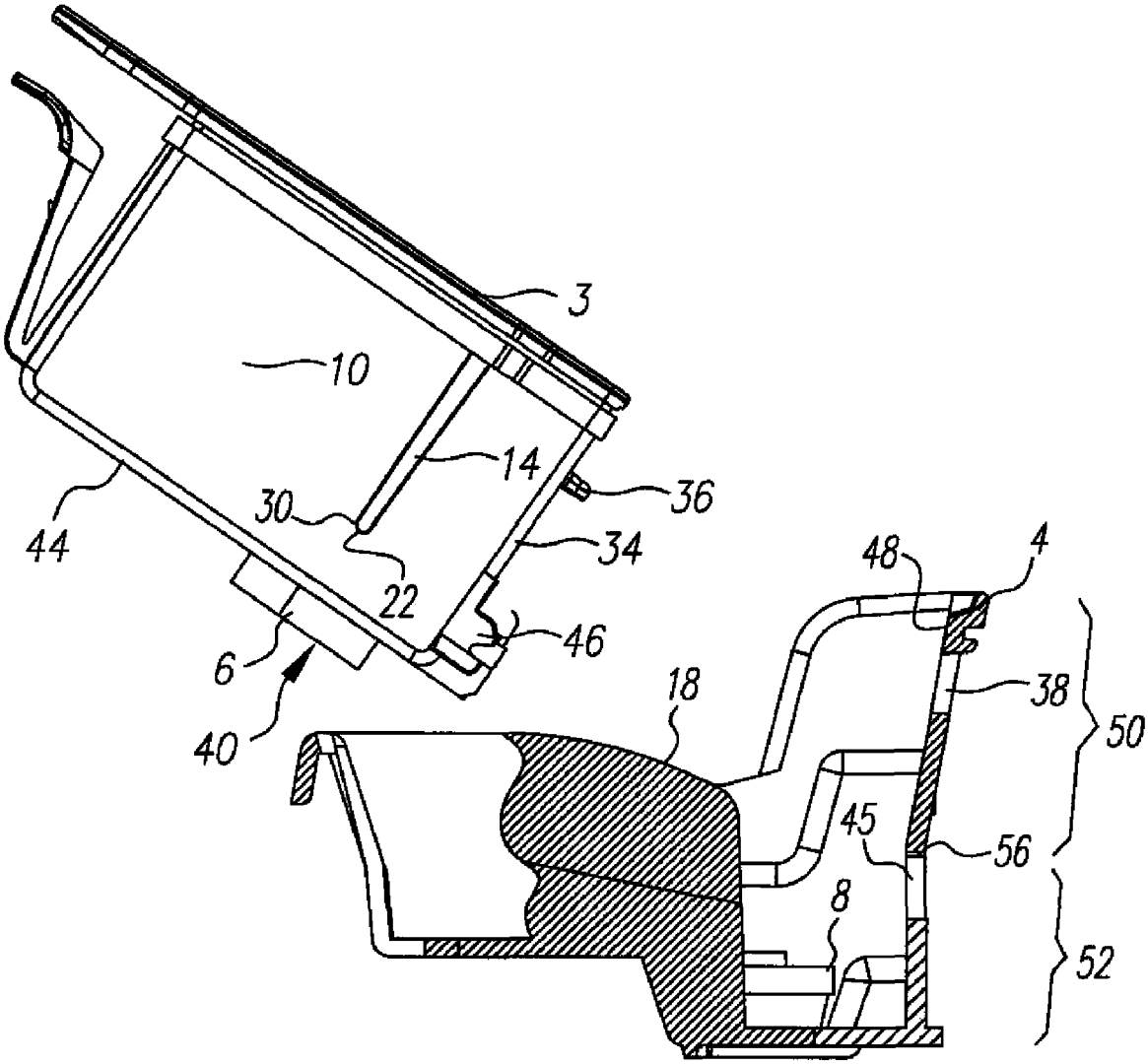
FIGS. 10-14 illustrate, in sequence, a multi-chamber fluid reservoir being inserted into a chassis, according to an embodiment of the present invention.

FIG. 8 illustrates a single-chamber fluid reservoir 2 in an engaged position when properly and completely inserted into the chassis 4, according to an embodiment of the present invention. In contrast, FIG. 9 illustrates a side view of a multi-chamber fluid reservoir 3 in an engaged position when properly and completely inserted into the chassis 4. It should be noted that in FIG. 9, the side of the chassis 4 (shown in diagonal-line) has been visually removed to reveal the placement of the reservoir 3 in the chassis 4, according to this embodiment. In the engaged positions illustrated in FIGS. 8 and 9, the additional alignment features 46 of the single-chamber fluid reservoir 2 and the multi-chamber fluid reservoir 3 are engaged with openings 47, 45 in the chassis 4, respectively. In this engaged position, when inserted into a printing device (not shown) the chassis 4 is configured to operate along a plane 28 that is substantially parallel to the plane of the printhead die 1. An axis 26 shown as a single dot in FIG. 9, but as a hashed line in FIGS. 1-4, which is drawn through a portion 30 of the first protrusion 14 through a portion 32 of the second protrusion 16, is parallel or substantially parallel to the plane 28.

FIGS. 10-14 illustrate, in sequence, a multi-chamber fluid reservoir 3 being inserted into a chassis 4, according to an embodiment of the present invention. The final step in the insertion sequence is shown with FIG. 9, previously discussed. Although not illustrated with figures, insertion of a single-chamber fluid reservoir 2 is similar to that illustrated in FIGS. 10-14 and described herein.

Figure 11:
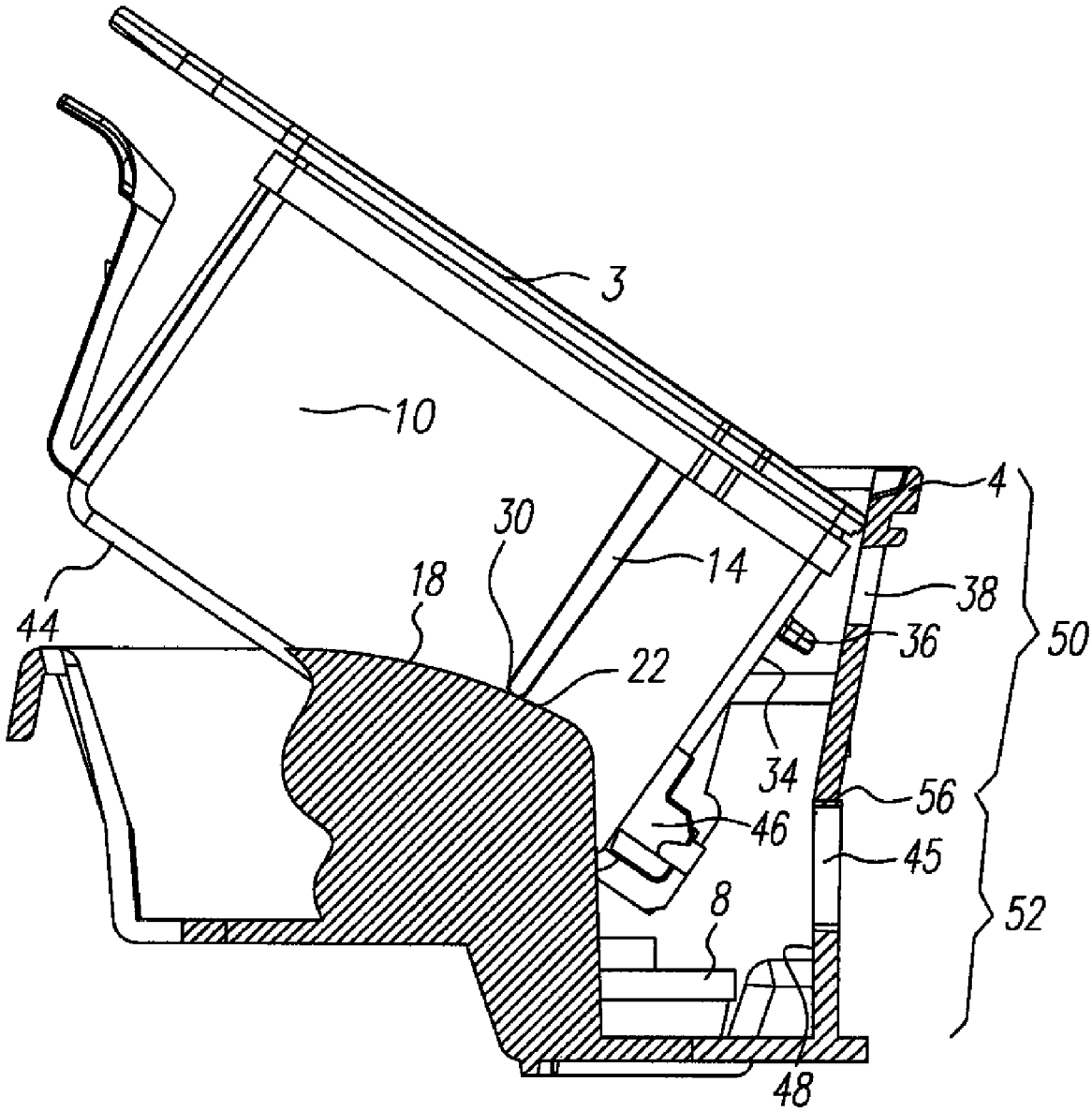
Figure 12:
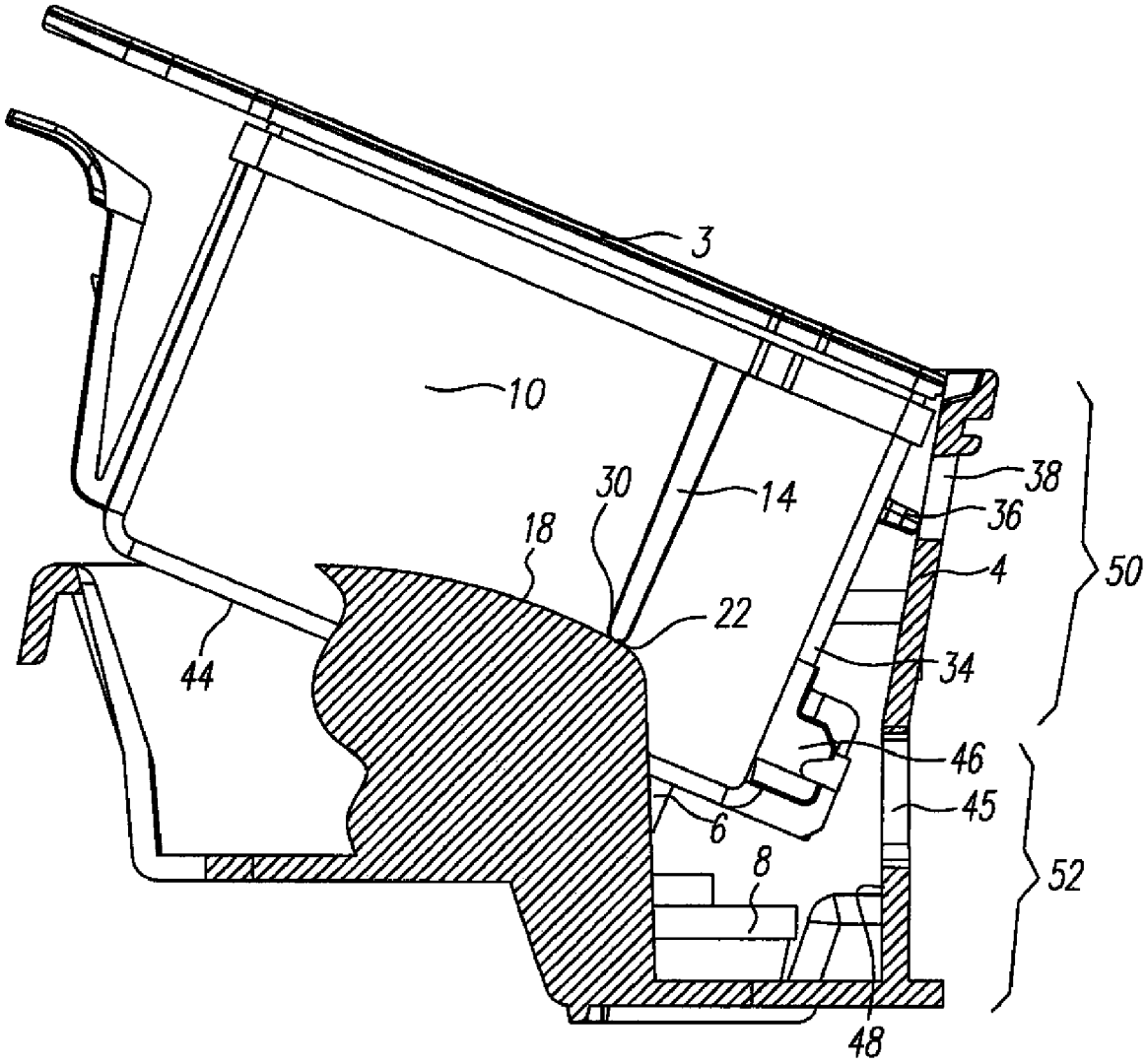

As shown in FIG. 11, a portion 30 of the first protrusion 14 is configured to interact with the first guide feature 18 of the chassis 4. Although not shown in FIG. 11, a portion 32 of the second protrusion 16 similarly is configured to interact with the second guide feature 20 of the chassis 4. According to an embodiment, the portions 30, 32 are bottom sides 22, 24, respectively, of the first protrusion 14 and the second protrusion 16. The first guide feature 18 and the second guide feature 20, according to this embodiment, are ramps that slope towards the engaged position of the fluid reservoir 4. To facilitate a smooth interaction between the first guide feature 18 and the first protrusion 14 (as well as the second guide feature 20 and the second protrusion 16) the portion 30, 32 that interacts with the first guide feature 18 and the second guide feature 20, respectively, may be rounded. Such rounding provides a line or substantially a line of contact (as opposed to a plane of contact as would occur with a flat surface) between portion 30 and the first guide feature 18. Such rounding also provides a single line of contact between portion 32 and the second guide feature 20. Typically, these lines of contact coincide or substantially coincide with the first axis 26 when the fluid reservoir is in an orientation that is parallel to the orientation of the installed fluid reservoir (e.g. when portions 30 and 32 contact the horizontal portions of first and second guide features 18 and 20). As portions 30 and 32 move along the curved regions of the guide features 18, 20, the single lines of contact are near to, but do not coincide with first axis 26. However, one skilled in the art will appreciate that such rounding is not necessary.

Figure 13:
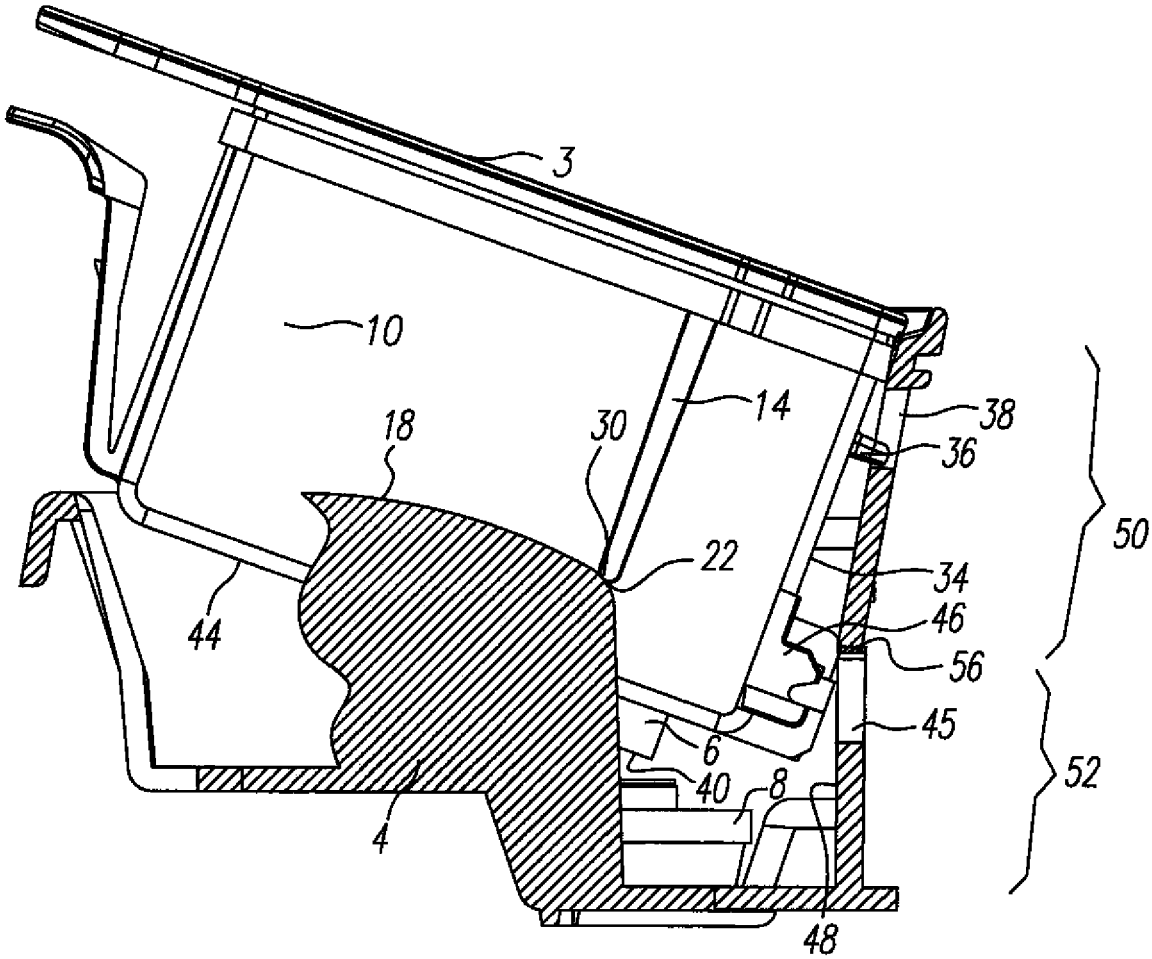
Figure 14:
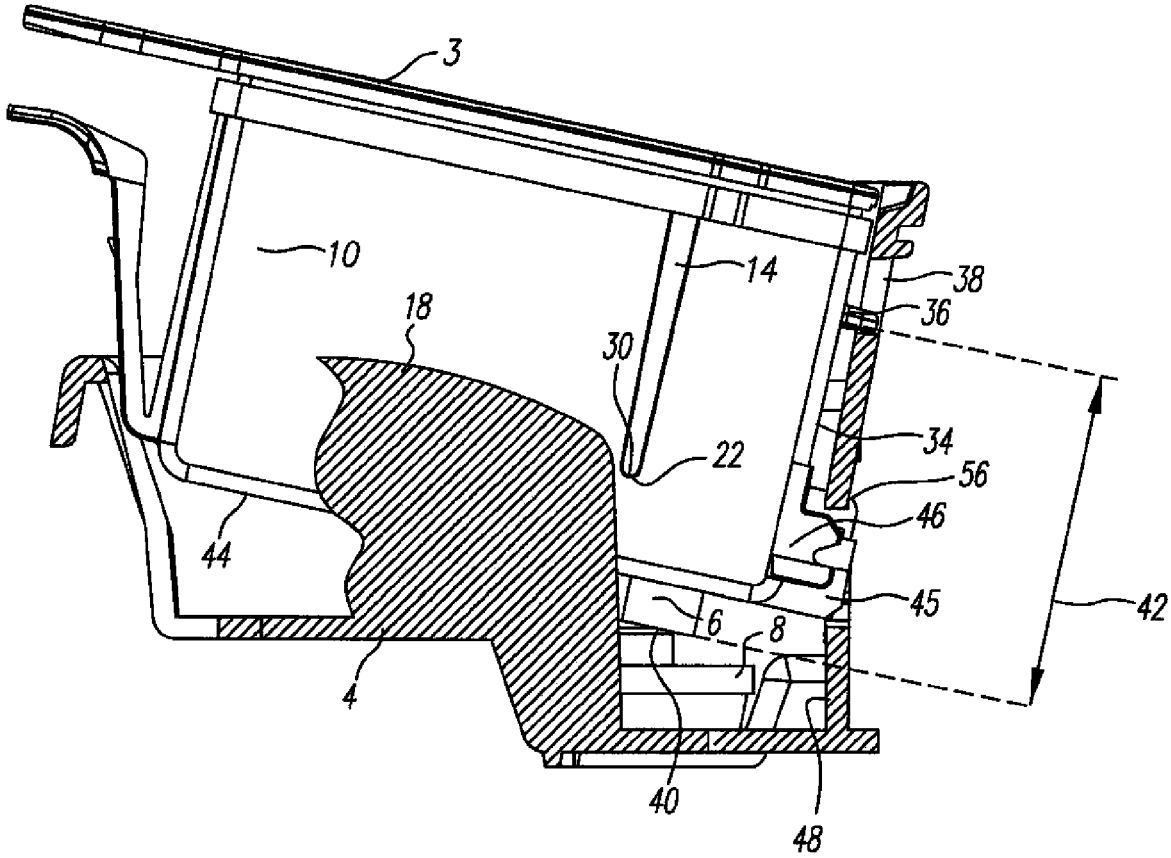

At this point in the insertion process, the first and second protrusions 14, 16, in conjunction with the first and second guide features 18, 20, respectively, are in control of aligning the fluid reservoir 3 and the chassis 4. FIG. 13 illustrates a point at which transition of alignment control shifts from (a) the first and second protrusions 14, 16 and the first and second guide features 18, 20, respectively to (b) the third protrusion 36 and the opening 38. From this angle, as the first protrusion 14 slides off of the first guide feature 18, the third protrusion 36 begins interacting with the opening 38 of the chassis 4 and, as well as maintaining proper alignment, keeps the fluid discharge port 6 from contacting or excessively contacting the fluid reception port 8. FIG. 14 illustrates release of the first protrusion 14 from the first guide feature 18 and the subsequent transfer of alignment control to the third protrusion 36 and the opening 38. After FIG. 14, the insertion process returns to FIG. 9 where, due to the inflection axis 56, (and optionally due to a length of third protrusion 36 which may be less than a length of additional alignment features 46 as measured from third surface 34) transfer of alignment control switches from (b) the third protrusion 36 and the opening 38 to (c) the additional alignment features 46 and the opening 45.

It is to be understood that the exemplary embodiments are merely illustrative of the present invention and that many variations of the above-described embodiments can be devised by one skilled in the art without departing from the scope of the invention. It is therefore intended that all such variations be included within the scope of the following claims and their equivalents.

PARTS LIST

1 Printhead die
2 Single-Chamber Fluid reservoir
3 Multi-Chamber Fluid Reservoir
4 Chassis
6 Fluid discharge port
8, 9 Fluid reception port
10 First surface of fluid reservoir
12 Second surface of fluid reservoir
14 First protrusion
16 Second protrusion
18, 19 First guide feature
20, 21 Second guide feature
22 Bottom side
24 Bottom side
26 First axis
28 Plane
30 Portion of first protrusion
32 Portion of second protrusion
34 Third surface
36 Third protrusion
38, 39 Opening
40 Bottom surface
42 Distance
44 Bottom surface
45 Opening
46 Additional alignment feature
47 Opening
48 Surface of chassis opposing direction
50 First alignment region
52 Second alignment region
54 Inside of chassis
56 Inflection axis of surface
58 Region for Multi-chamber fluid reservoir
60 Region for Single chamber fluid reservoir
80 Width

What is claimed is:

1. A chassis configured to retain a fluid reservoir for a printing device, the chassis comprising:

a surface opposing a direction in which the fluid reservoir is inserted into the chassis;

a first alignment region in or on the surface and configured to interact with a first alignment feature on the fluid reservoir;

a second alignment region in or on the surface and configured to interact with a second alignment feature on the fluid reservoir;

a first guide feature; and a second guide feature, wherein to facilitate insertion of the fluid reservoir into the chassis, the first guide feature is configured to interact with a first protrusion from the fluid reservoir, and the second guide feature is configured to interact with a second protrusion from the fluid reservoir, and wherein the surface inflects along an axis located between the first alignment region and the second alignment region in order to facilitate transitioning alignment control from the first alignment feature to the second alignment feature when the fluid reservoir is inserted into the chassis.

2. The chassis of claim 1, wherein the first alignment region comprises an opening in the chassis configured to receive the first alignment feature on the fluid reservoir when the fluid reservoir is inserted into the chassis.

3. The chassis of claim 1, wherein the second alignment region comprises an opening in the chassis configured to receive the second alignment feature on the fluid reservoir when the fluid reservoir is inserted into the chassis.

4. The chassis of claim 1, further comprising a fluid reception port, wherein the second alignment region is located closer to the fluid reception port than the first alignment region.

5. The chassis of claim 1, wherein an inside of the chassis is configured to receive the fluid reservoir, and wherein the surface inflects in a manner that makes the surface or a substantial portion thereof convex towards the inside of the chassis.

6. The chassis of claim 1, wherein the chassis is configured to retain a plurality of fluid reservoirs.

7. The chassis of claim 6, wherein the chassis is configured to retain at least one fluid reservoir of the plurality of fluid reservoirs that contains a plurality of fluid chambers each configured to retain its own supply of fluid, and wherein a first fluid chamber of the plurality of fluid chambers retains a different color fluid than a second chamber of the plurality of fluid chambers.

8. The chassis of claim 6, wherein the chassis is configured to retain at least one fluid reservoir of the plurality of fluid reservoirs that contains only a single fluid chamber configured to retain its own supply of fluid.

9. The chassis of claim 1, wherein the chassis is configured to retain only a single fluid reservoir.

10. The chassis of claim 1, wherein the chassis is configured to retain only a single fluid reservoir that contains a plurality of fluid chambers each configured to retain its own supply of fluid.

11. The chassis of claim 1, wherein the chassis is configured to retain only a single fluid reservoir that contains only a single fluid chamber configured to retain its own supply of fluid.

12. The chassis of claim 1, wherein the first alignment region comprises an opening through the chassis configured to receive the first alignment feature on the fluid reservoir when the fluid reservoir is inserted into the chassis.

13. The chassis of claim 1, wherein the second alignment region comprises an opening through the chassis configured to receive the second alignment feature on the fluid reservoir when the fluid reservoir is inserted into the chassis.

14. The chassis of claim 1, further comprising a fluid reception port, wherein the second alignment region is located between the axis and the fluid reception port.

* * * * *